US005147690A

United States Patent [19]

Faust et al.

[11] Patent Number: 5,147,690

[45] Date of Patent: Sep. 15, 1992

[54] PROCESS AND APPARATUS FOR DRYING A LIQUID FILM APPLIED TO A MOVING SUBSTRATE

[75] Inventors: Horst Faust; Guenter Hultzsch, both of Wiesbaden; Reinhard Nies, Hamburg, all of Fed. Rep. of Germany

[73] Assignee: Hoechst Aktiengesellschaft, Frankfurt am Main, Fed. Rep. of Germany

[21] Appl. No.: 570,848

[22] Filed: Aug. 22, 1990

[30] Foreign Application Priority Data

Aug. 22, 1989 [DE] Fed. Rep. of Germany ..... 3927627

[51] Int. Cl.[5] ..... B05D 3/02; F26B 13/00

[52] U.S. Cl. ..... 427/372.2; 34/156; 118/58; 118/63

[58] Field of Search ..... 34/155, 156, 154, 160; 432/59; 118/58, 61, 63, 64, 65; 427/226, 348, 372.2, 379

[56] References Cited

U.S. PATENT DOCUMENTS

| | | | |
|---|---|---|---|
| 3,012,335 | 12/1961 | Allander et al. | 34/155 |
| 3,060,594 | 10/1962 | Meier-Windhorst | 34/156 |
| 3,559,301 | 2/1971 | Fraser | 34/156 |
| 3,577,653 | 5/1971 | McClenathan et al. | 34/156 |
| 3,979,038 | 9/1976 | Karlsson | 34/156 X |
| 4,905,381 | 3/1990 | Poterala | 34/155 |

FOREIGN PATENT DOCUMENTS

| | | |
|---|---|---|
| 0247547 | 12/1987 | European Pat. Off. . |
| 1129444 | 5/1962 | Fed. Rep. of Germany . |
| 1098271 | 7/1955 | France . |
| PCT/US 82/00371 | 3/1982 | PCT Int'l Appl. . |
| 459070 | 8/1968 | Switzerland . |
| 847548 | 9/1960 | United Kingdom . |

OTHER PUBLICATIONS

Martin et al., "Ursachen der Randübertrocknung in Schlitzdüsentrocknern," Chemie Ingenieur Technik, 42, issue 14, 1970, pp. 927–929.

Martin, "Berechnung der Schlitzweite eines Schlitzdüsenfeldes under der Bedingung konstanten Wärme- und Stoffüberganges in Abströmrichtung," Chemie Ingenieur Technik, 43, issue 8, 1971, pp. 516–519.

Martin et al., "Optimierung von Schlitzdüsentrocknern auf Grund neuer Versuchsergebnisse über den Wärme- und Stoffübergang in solchen Apparaten," Chemie Ingenieur Technik, 45, issue 5, 1973, pp. 290–294.

Kramer et al., "Schwebetrockner für beschichtete Blechbänder," Journal gas wärme international, vol. 24, 1975, No. 12, pp. 527–531.

*Primary Examiner*—Henry A. Bennet

*Attorney, Agent, or Firm*—Foley & Lardner

[57] ABSTRACT

An apparatus for drying a liquid film on a substrate web which includes a lower gas or air supply system and an upper gas or air supply system. The substrate strip is subjected to a flow of hot supply air (or gas) without mechanical support of guide elements, which air (or gas) forms a carrying cushion and at the same time supplies drying energy to the liquid layer applied to the substrate. The exhaust air (or exhaust air) is carried away through return channels. Slots for the gas or air supply and the return channels for the gas or air removal are arranged alternately in the lower gas or air supply system. The upper gas or air supply system has a greater width than the lower gas or air supply system. In the upper gas or air supply systen, the supply air or the gas is diverted by baffles onto the substrate and returned over the substrate web as return air or gas. The upper gas or air supply system is subdivided into sections for the supply air and exhaust air or the inflowing gas and outflowing gas, each section including two filter plates of porous material.

21 Claims, 6 Drawing Sheets

PROCESS AND APPARATUS FOR DRYING A LIQUID FILM APPLIED TO A MOVING SUBSTRATE

BACKGROUND OF THE INVENTION

The present invention relates to a process and an apparatus for drying, by means of a heated drying gas, a liquid film which is applied to a moving substrate and includes vaporizable solvent components and solid components.

Different conventional drying processes and drying apparatuses are used in the drying of materials of large surface area in web form to which liquid films have been applied. Typical materials for drying are, for example, metal or plastic webs, to which liquid films have been applied, which generally consist of vaporizable solvent components, which are removed from the liquid film during the drying process, and of non-vaporizable components, which remain on the substrate after drying.

The coating lends the surfaces of the substrates special properties, which exist in the form desired for subsequent use only after the drying process. An example is the coating of metal webs with light-sensitive layers, which are made up into printing plates. The coating of metal webs or plastic films with substances in the form of a solvent-containing wet film, referred to hereinafter as liquid film, and the subsequent drying thereof consequently represent an operation which requires special installations in order to ensure the desired product quality of the coatings. An essential process step in this operation is the drying of the liquid film which is the final step in the coating process.

In the drying of liquid films on substrates it is usual that a heated gas, in particular air, flows over the surface of the substrates to remove the solvent components from the layer of film. In so doing the heated gas stream is brought into direct contact with the liquid film, which is applied in a layer of even distribution to the substrate which runs through a drying apparatus. In order to ensure a dried film surface which is free from striae and mottling, i.e., an even distribution of the remaining components, the drying installations are equipped with devices which are intended to accomplish a favorable or even distribution of the airflow above the liquid film. The goal of the drying installations is to achieve an even drying over the entire width of the coated web. Furthermore, known drying installations have devices for minimizing disturbances of the air movements which, partly due to turbulent flow movements, have an adverse affect on the film surface which results in mottling.

According to U.S. Pat. No. 3,012,335, a typical design of such a drying apparatus comprises supplying a gas space immediately above the liquid film to be dried with drier gas from a gas space which contains drier gas and is arranged at a certain distance above the web being coated, by means of a multiplicity of slots, nozzles, holes or porous solid bodies. This involves the continuously coated strip or plates on a circulating conveyor belt being passed through the drying apparatus continuously with solvent vapor given off to the drier air. In this operation, the introduced drier air can be constantly renewed in an open circuit and the air enriched with solvent can be completely evacuated. A recirculated air process with partially-renewed drier air and solvent-enriched air may also be used.

Difficulties in evacuating the drier air from the drying space often arise from the fact that, with longitudinal nozzles, or longitudinal slots, arranged transversely with respect to the web advancing direction, a reduction in the nozzle exit velocity occurs in the middle of nozzle banks of slot-type nozzle driers due to the pressure drop in the laterally flowing evacuated gas and consequently the heat and mass transfer is influenced transversely to the web advancing direction. This results in an overdrying at the edges, which in the case of many coating operations causes undesired structuring effects on the dried films.

Therefore, proposals for optimizing the design of nozzle banks in slot-type nozzle driers, which are intended to ensure a constant heat and mass transfer over the entire web width of a drier, are given in the technical journal "Chemie-Ingenieur-Technik", 42nd year, issue 14 (1970), pages 927–929, 43rd year, issue 8 (1971), pages 516to 519 and 45th year, issue 5 (1973), pages 290 to 294. For the optimization of slot-type nozzle driers, mass transfer measurements in impact flow from slot-type nozzle banks having different nozzle surface areas are correlated empirically taking into consideration a broad range of external influencing variables. The relationship found is used to determine optimum nozzle geometries in relation to the fan output per $m^2$ of material surface. This relationship shows that a constant heat and mass transfer is achieved over the web width by the nozzle slots having a slot width which increases continuously from the edge of the web towards its middle.

When drying webs of material having a large surface area, it is often required for the heat and mass transfer to be very even over the width of the web, in order to avoid local over-drying and the associated deterioration in quality. In these cases, slot-type nozzle banks in which the slots are arranged transversely to the advancing direction of the web preferably are used. The over-drying at the edges thereby observed in the slot-type nozzle drier having an evacuated gas flow path in the direction of the slots is attributable to the distribution of the exit velocity along the slots. In order to avoid this over-drying at the edges, it follows from this, inter alia, for nozzle driers that the surface area near the substrate for the gas evacuation should be at least 3.5 times the nozzle exit surface area in order to obtain an even drying over the width of the web of material.

The current state of the art is to perform a surface treatment on gas-supported web substrates in suspension driers for plasticsheet or metal strips with the aid of a carrying air nozzle system (Journal "gas wärme international", Volume 24(1975), No. 12, pages 527 to 531). In this treatment, the drier air enriched with solvent also is extracted again directly in the nozzle banks, in order to eliminate the undesired transversal flow. This produces so-called nozzle driers or impact-jet driers, in which a particular disadvantage is the stagnation point-like flow of individual nozzles, which has a tendency both with a laminar form of flow and with a turbulent form of flow towards flow-physical instabilities which, in particular, in the case of low-viscosity liquid films, inevitably result in irreversible drying structures.

To avoid stagnation point-like flows in the initial region of the drier apparatus, according to PCT Application W082/03450, the drier air is passed from an ante chamber via suitable inlet openings and flow deflectors into a stabilized intermediate space, from there part of the drier air flows via a porous filter element, arranged in the direct vicinity of the liquid film, on to the web to be dried. Such drying is based on the principle that a weak flow of air which is stabilized but highly enriched with solvent forms between the porous filter element, which acts as a protective shield, and the liquid film to be dried and is constantly renewed by exchange with the residual air flowing away transversely above the porous medium and consequently, on account of the relatively short overall length, a pre-drying of the liquid film with a reduced tendency towards the appearance of mottling effects is achieved.

This type of drying is characterized by predominate diffusion of the solvent vapor/air mixture through the porous protective shield, in which, with virtually no convective evacuation at all within the space between strip and protective shield, a complete drying of the liquid film is only possible if the driers are very long or if downstream auxiliary driers are added.

SUMMARY OF THE INVENTION

It is therefore an object of the present invention to provide a process and an apparatus wherein a solvent component of a liquid film on a moving substrate vaporizes quickly and in a sufficient amount in an initial drying step so that the liquid film is resistant to adverse blowing effects in a subsequent drying step.

In accomplishing the foregoing object there is provided according to the present invention a process for drying, by means of a heated drying gas, a liquid film which is applied to a moving substrate and includes vaporizable solvent components and solid components, comprising the steps of suspending the moving substrate on a carrying cushion of the heated drying gas which flows against the underside of the moving substrate, vaporizing a substantial portion of the solvent components via the contact between the heated drying gas and the underside of the moving substrate and removing the vaporized solvent components from the upper side of the liquid film with the aid of a circulating gas stream. The process comprises a lower gas system which includes passing the heated drying gas towards the moving substrate through a plurality of slots arranged transversely to the advancing direction of the moving substrate, flowing the heated drying gas along the underside of the moving substrate and removing the heated drying gas via a plurality of return channels. The process also comprises an upper gas system which includes passing a supply gas through a first porous plate, flowing the supply gas along the upper side of the liquid film such that the supply gas becomes enriched with the vaporized solvent components and exhausting the solvent-enriched gas through a second porous plate.

There also is provided according to the present invention an apparatus for drying, by means of a heated drying gas, a liquid film which is applied to a moving substrate, comprising an upper gas supply system arranged above the moving substrate, a lower gas supply system arranged underneath the moving substrate, an applying device which applies the liquid film to the moving substrate and means for advancing the substrate, which is suspended freely on a carrying cushion produced by the lower gas supply system, through a drying zone. The lower gas system may comprise a plurality of slots arranged transversely to the advancing direction of the substrate, through which slots a gas supply passes, and a plurality of return channels for removal of the gas, wherein the slots and return channels are arranged alternately such that the gas introduced through the slots flows along the underside of the moving substrate and then is exhausted via the return channels. Alternatively, the lower gas system may comprise a plurality of cylindrical bodies spaced apart so as to form gaps for passage of the gas. The upper gas system comprises a first section for the introduction of a gas and a second section for removal of an exhaust gas, wherein each section includes a process filter plate, between which plates there is a gap.

Further objects, features and advantages of the present invention will become apparent from the detailed description which follows.

BRIEF DESCRIPTION OF THE DRAWINGS

The present invention is described in further detail below with reference to illustrative embodiments represented in a drawing, in which.

DETAILED DESCRIPTION OF THE PREFERRED EMBODIMENTS

Figure 1:
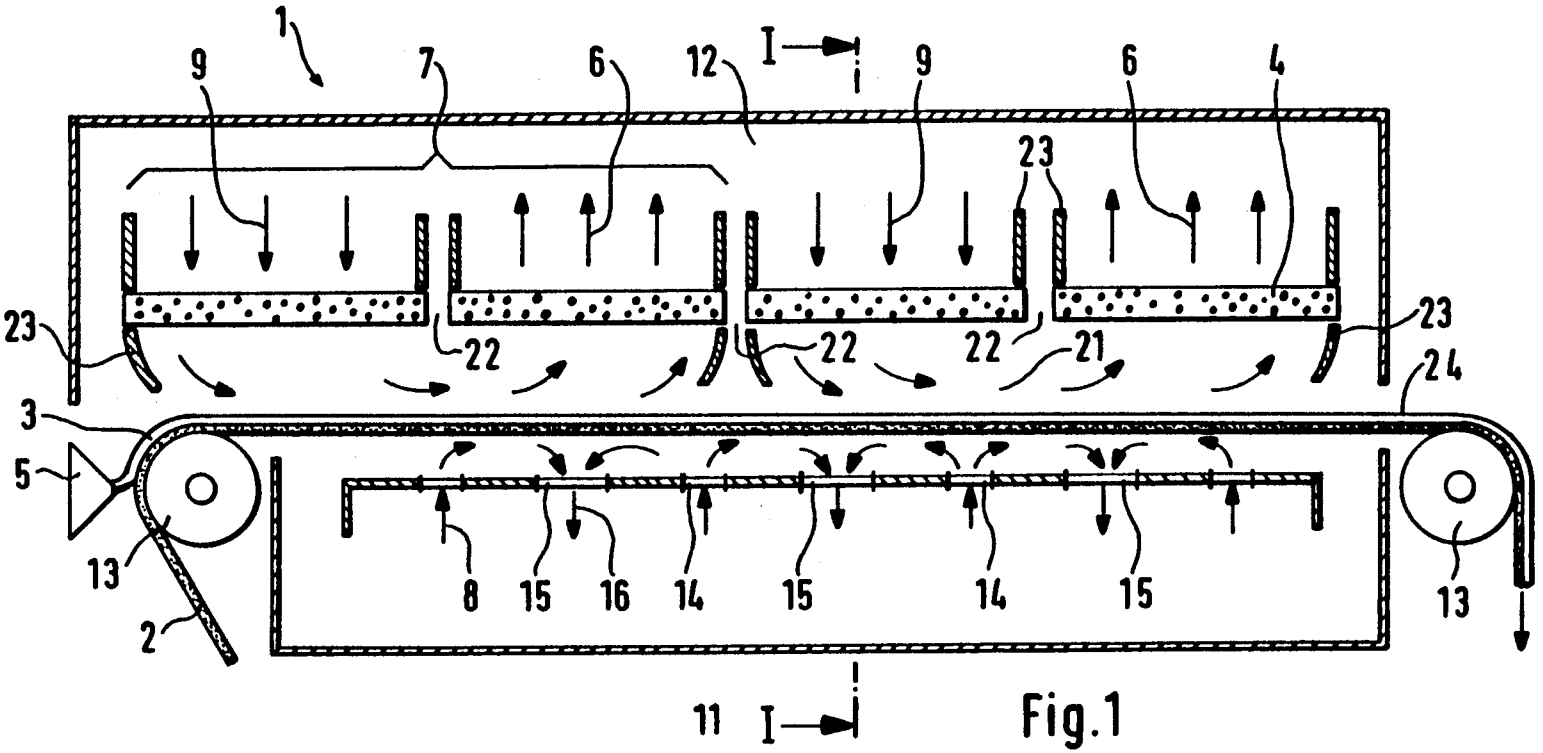
FIG. 1 diagrammatically shows a longitudinal section of a first embodiment of the apparatus, according to the present invention with horizontal substrate web, FIG. 2 diagrammatically shows a longitudinal section of a second embodiment of the apparatus, similar to the first embodiment, but with a curved substrate web.

According to the present process, the substrate is taken along a web while freely suspended on a carrying cushion of the drying gas which flows against the underside of the substrate, wherein a substantial portion of the solvent components are vaporized by the heated drying gas and the vaporized solvent components are carried away from the upper side of the liquid film with the aid of gas.

In the present process or apparatus, the substrate advances horizontally or along a curved web through the drying zone and carries the liquid film to be dried on its upper side.

In a preferred embodiment of the present process, the drying gas is air, which is heated and supplies the drying energy for the liquid film to the substrate and the air supply systems on the upper side and the underside of the substrate are separate from each other.

In the present process, the two gas or air supply systems are operated openly, one opposite the other, and laterally flowing excess gas or excess air of the upper gas or air supply system is carried away by the exhaust gas or the exhaust air of the lower gas or air supply system.

In this embodiment, the width of the gas or air supply system on the upper side of the substrate web is selected to be wider than the width of the air supply system on the underside of the substrate web.

In a further embodiment of the present process, the air is fed laminarly and evenly by the upper air supply system, the differential speed between the substrate and the air from the application point for the liquid film to the end of the pre-drying being less than 0.25 m/sec.

The present process is applied either in such a way that the substrate is advanced horizontally level and the gas or air supply system on the underside of the substrate similarly is aligned horizontally and level, or that the substrate is advanced in a curved path and the gas or air supply system on the underside of the substrate is aligned with the same curvature as the substrate.

An apparatus according to the present invention for drying, by means of a heated drying gas or drying air, a liquid film which is applied to a moving substrate and includes vaporized or solvent components and solid components includes the features that a gas or air supply system is arranged both underneath and above the moving substrate to which an applying device applies a liquid film, and that, while freely suspended, the substrate is advanced along a web on a carrying cushion produced by the lower gas or air supply system through the drying zone.

In a further embodiment of the present apparatus, the lower gas or air supply system has slots arranged transversely to the advancing direction of the substrate for the gas or air supply and return channels for the gas or air removal and the slots and the return channels alternate, in order to carry away the gas or the air which leaves the slots arranged to the left and right of a return channel between the substrate and the upper side of the gas or air supply system into the return channel.

In FIG. 1, a longitudinal section of a first embodiment of an apparatus 1 according to the present invention is represented diagrammatically. A substrate 2 is taken around a roller 13 and runs horizontally through the apparatus 1 to a further roller 13, around which the substrate 2 is deflected from the horizontal position into a vertical position. In the region of the first roller 13 there is an applying device 5, for example a fishtail nozzle, through which a liquid film 3 is applied to the substrate 2. The liquid film 3 contains vaporizable solvent components and solid components, which are for example light-sensitive. The present invention is described with reference to an apparatus in which a liquid film is dried, the solid components of which film are light-sensitive or photo-sensitive substances which are applied continuously to a metal web and dried. However, the invention is in no way restricted to light-sensitive film, but rather can be employed for drying other liquid films which are sensitive to adverse blowing effects from air or gas flows. Furthermore, instead of metal webs, webs of plastic sheet, paper or the like may form the substrate.

The applying device 5 is, for example, arranged tangentially such that it is at the 9 o'clock position, adjacent to the first roller 13. The substrate 2, with the liquid film 3 on top, is taken along the horizontally advancing substrate web 24 through the apparatus 1. Below and above the substrate web 24 there are air or gas supply systems 11 and 12, respectively. The lower gas or air supply system 11 has a smaller width than the upper gas or air supply system 12. The following text mentions only air removal and air supply systems, these terms, however also can represent gas removal and gas supply systems using, for example, inert gases. Both air supply systems are in each case accommodated in housings not referred to in any further detail. While freely suspended, the substrate 2 is taken through a drying zone 21 of the apparatus 1 along the substrate web 24 by means of an air-carrying cushion, which is produced by the lower air supply system 11. For this purpose, the lower air supply system 11 has slots 14, which are arranged transversely to the advancing direction of the substrate 2 and through which supply air 8 flows against the underside of the substrate 2. This supply air 8 of the lower air supply system 11 is generally heated air. In addition to the slots 14 there are in the upper side of the air supply system 11 return channels 15 through which the exhaust air 16 is extracted. The slots 14 and the return channels 15 are arranged alternately, so that the supply air 8 flows out of the slots 14 on the left and right of a return channel 15, between the underside of the substrate 2 and the upper side of the air supply system 11, and along the underside of the substrate in the direction of the associated return channel 15. As a result, the back of the coated substrate 2 is heated up with hot air, by which the necessary drying energy is supplied, which results in a rapid vaporizing of the greatest proportion of the solvent components.

The solvent vapors produced on the upper side of the substrate web 24 or the upper side of the coated substrate web 2 are evacuated by the upper air supply system 12. This system is sub-divided into sections 7 for the supply air 9 and the exhaust air 6, the latter being the return air enriched with vapors of the solvent components. Each section 7 comprises two filter plates 4 of a material provided with pores, a gap 22 being left open between these two filter plates 4. The supply air 9 is diverted by baffles 23 onto the coated substrate 2 and returned over the surface of the substrate web 24 as exhaust air or return air 6. The baffles 23 are arranged in pairs and curved slightly inwards on the underside of the sections 7, terminating with the side edges of the filter plates 4 of a section 7. The baffles are arranged upright above the filter plates 4.

The apparatus 1 operates on the principle that the rear of the coated substrate 2 being heated with hot air results in the vapors of the solvent components being evacuated on the film side by a conduction of air on the upper side of the substrate 2 which does not harm the film. Drying is completed when solvent components have been sufficiently vaporized, so that the solids components remaining on the substrate 2 form a film which has become substantially insensitive to adverse blowing by gas flows or air flows during subsequent drying. Of course, instead of air another gas, for example nitrogen, can be used for drying.

Depending upon the desired drying rate, any number of sections 7 can be provided in the upper air supply system 12, via which supply air is fed in and exhaust air flows away. The flow profile of the supply air and exhaust air flowing through the porous materials of the filter plates 4 is laminar and even, the differential speed between the coated substrate 2 and the supply air 9 from the applying device 5 to the end of the pre-drying zone 21 being less than 0.25 m/sec. It is thereby ensured that no adverse film blowing of the liquid film 3 occurs. The return or exhaust air 6, enriched by the vaporizing of the solvent components, is fed by the upper air supply system 12 to, for example, a condenser (not shown) for the solvent component vapors, in which condenser the vapors condense into the liquid solvent components and are either reprocessed or, after appropriate treatment, can be formed into environmentally safe products for dumping.

Since the working width of the upper air supply system 12 preferably is greater than the working width of the lower air supply system 11, and consequently also greater than the greatest substrate width, an undisturbed air movement above the coated substrate 2 is obtained. The special design of the lower air supply system 11 with the slots 14 and the return channels 15 ensures a smooth and vibration-free advancing of the coated substrate 2 along the substrate web 24.

Figure 2:
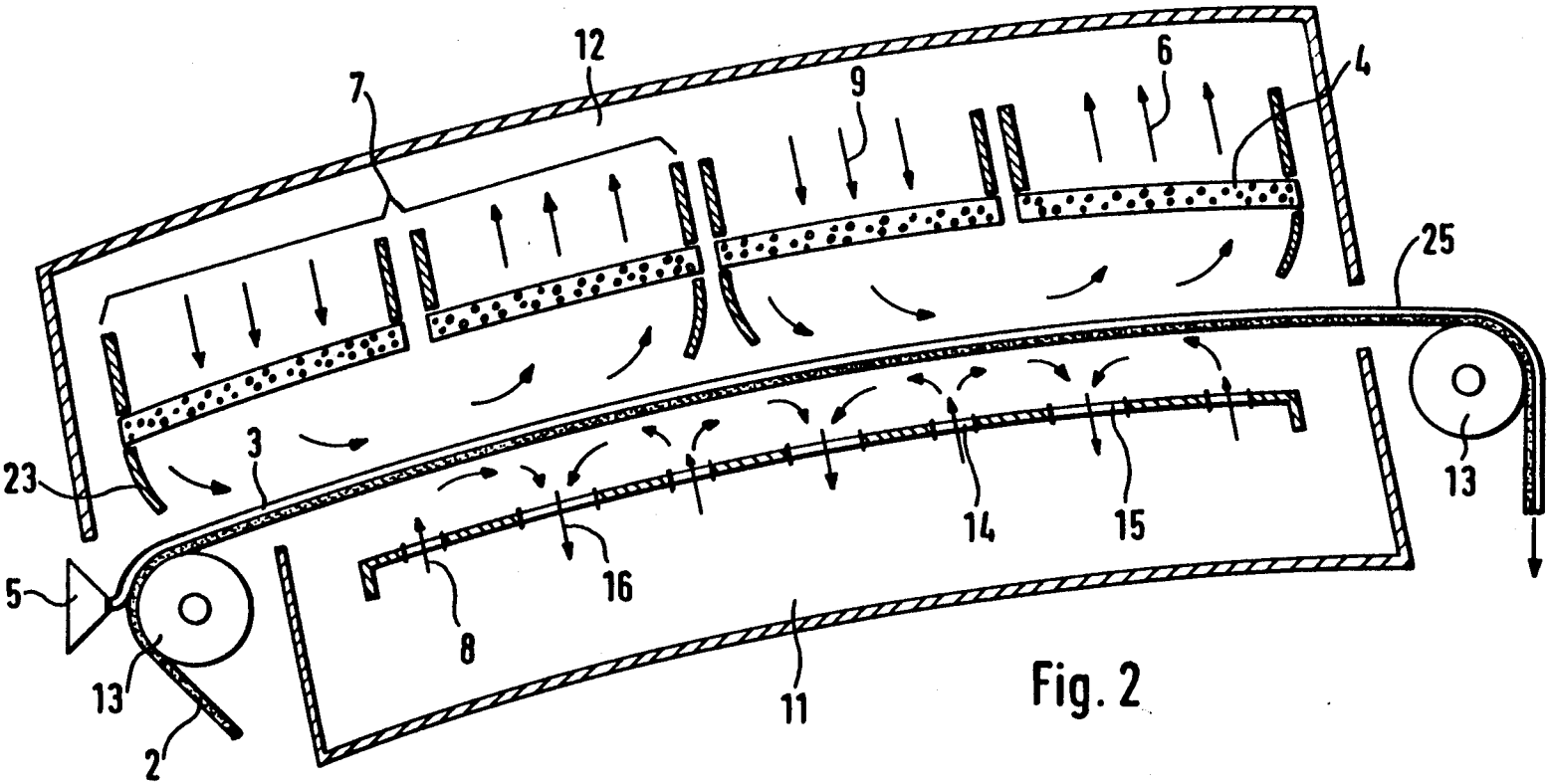

According to the second embodiment of the apparatus 1, as shown diagrammatically in FIG. 2, the substrate web 25 advances in an arc of slight curvature. The air supply systems 11 and 12 are likewise arranged in a curved configuration and at a predetermined distance from the curved substrate web 25. All other structural units of this second embodiment correspond substantially to the components of the first embodiment and are therefore not described again.

Figure 3:
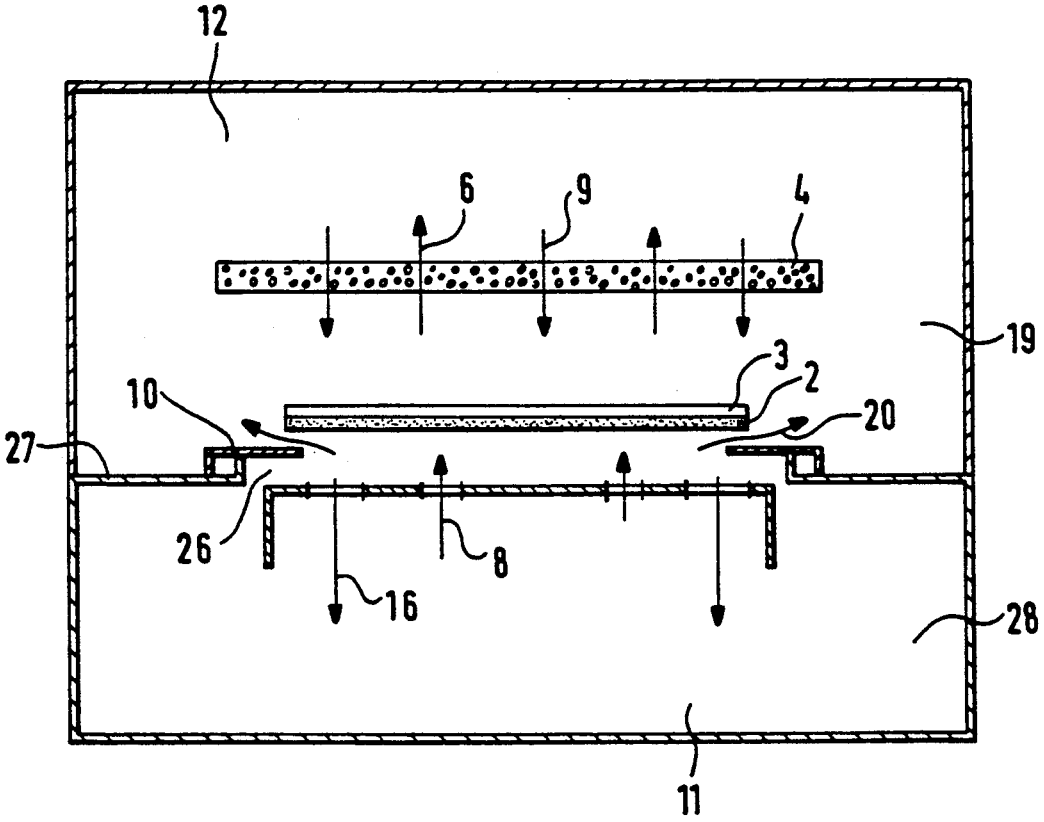
FIG. 3 shows a cross-section through the first embodiment according to FIG. 1, along the line I—I, FIG. 4 diagrammatically shows a longitudinal section through the lower gas or air supply system of a third embodiment of the apparatus according to the present invention.

The cross-sectional representation in FIG. 3 along the line I—I of FIG. 1 reveals that the two air supply systems 11 and 12 are designed to be open, one opposite the other, and are separated from each other only by a dividing wall 27 with an opening 26, the coated substrate 2 being above the opening 26. The supply air 8 of the lower air supply system 11 is prevented from flowing directly to the upper air zone 19 by the substrate 2 coated with the liquid film 3 and lateral covering plates 10. The small quantities of air which flow in laterally and at the edges of the substrate 2 and the covering plates 10 as excess air 20 from a lower air zone 28 into the upper air zone 19 are evacuated by the exhaust air or return air 6 of the upper supply system 12. Conversely, excess air of the upper air supply system is carried away by the exhaust air of the lower air supply system.

Figure 4:
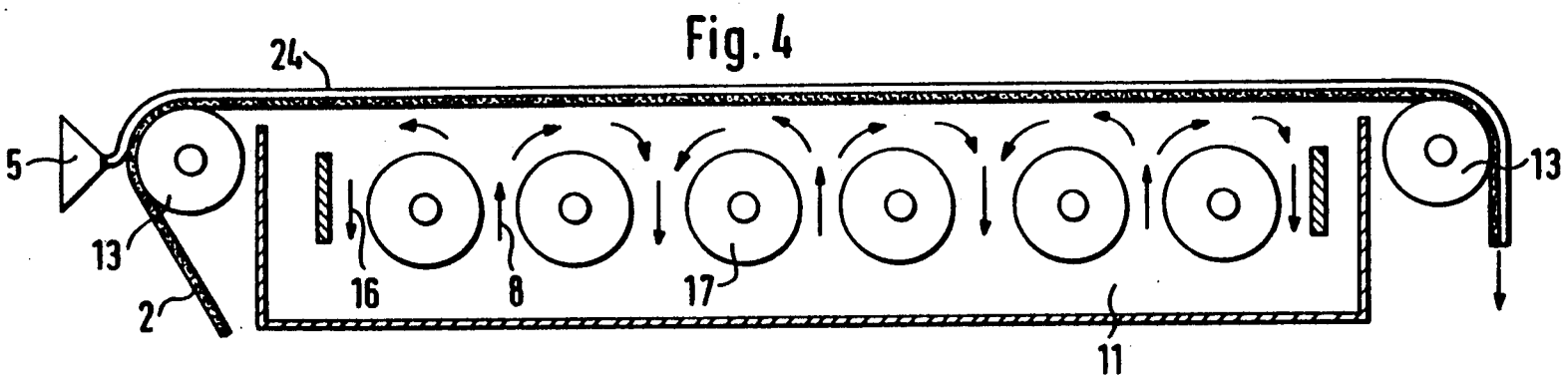
Figure 5:
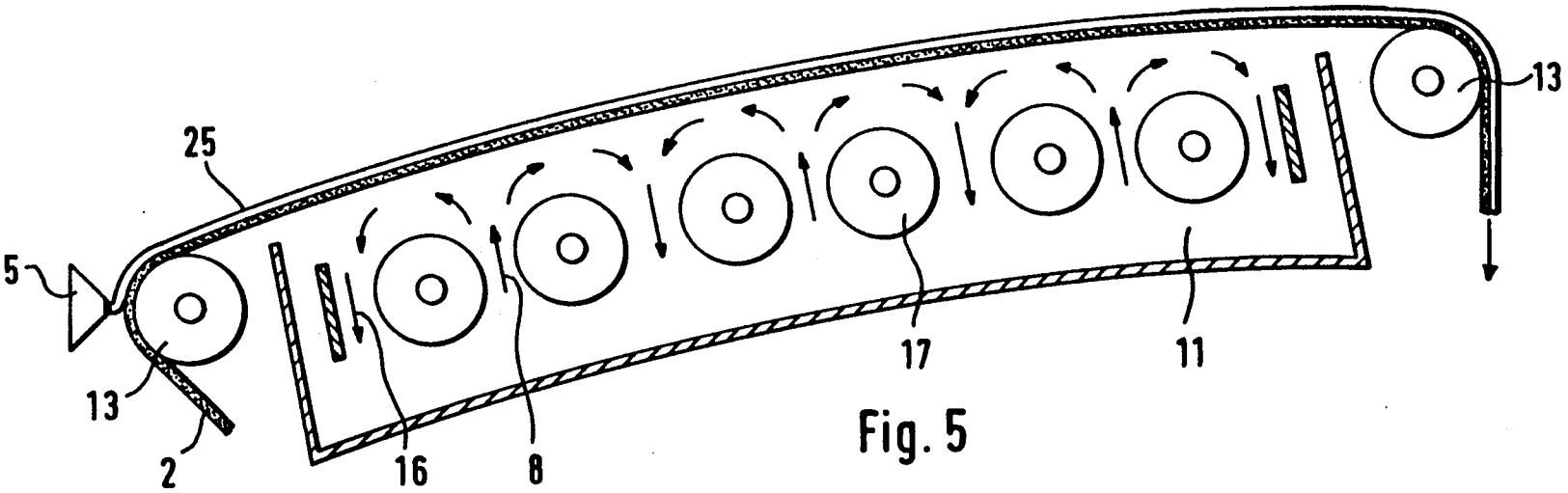
FIG. 5 shows a longitudinal section through the lower gas or air supply system of a fourth embodiment of the apparatus, with a curved instead of horizontal path of the substrate, FIG. 6 diagrammatically shows a longitudinal section through the lower gas or supply system of a fifth embodiment of the apparatus according to the present invention, FIG. 7 diagrammatically shows a longitudinal section through the lower gas or air supply system of a sixth embodiment of the apparatus, similar to FIG. 6 with a curved instead of horizontal substrate web.

The lower air supply systems of a third embodiment and fourth embodiment of the apparatus according to the present invention shown in FIGS. 4 and 5 differ from each other only in that in the third embodiment the substrate 2 is taken along a level, horizontal substrate web 24 and in the fourth embodiment the substrate web 25 and similarly the lower air supply system 11 are slightly curved. In both the third embodiment and the fourth embodiment, the air supply system 11 comprises a plurality of cylindrical bodies 17 spaced apart from each other so as to form gaps which are arranged in transverse direction to the substrate web 24 and 25, respectively. The supply air 8 can flow in and the exhaust air 16 can flow away through the gaps between the cylindrical bodies 17. According to a fourth embodiment shown in FIG. 5, the cylindrical bodies 17, spaced apart from one another, are arranged along an arc which has the same curvature as the substrate web 25. The cylindrical bodies 17 are heated by the incoming hot supply air 8, as a result of which such an air supply system 11 is distinguished by a particularly good and even heating of the substrate 2.

Figure 6:
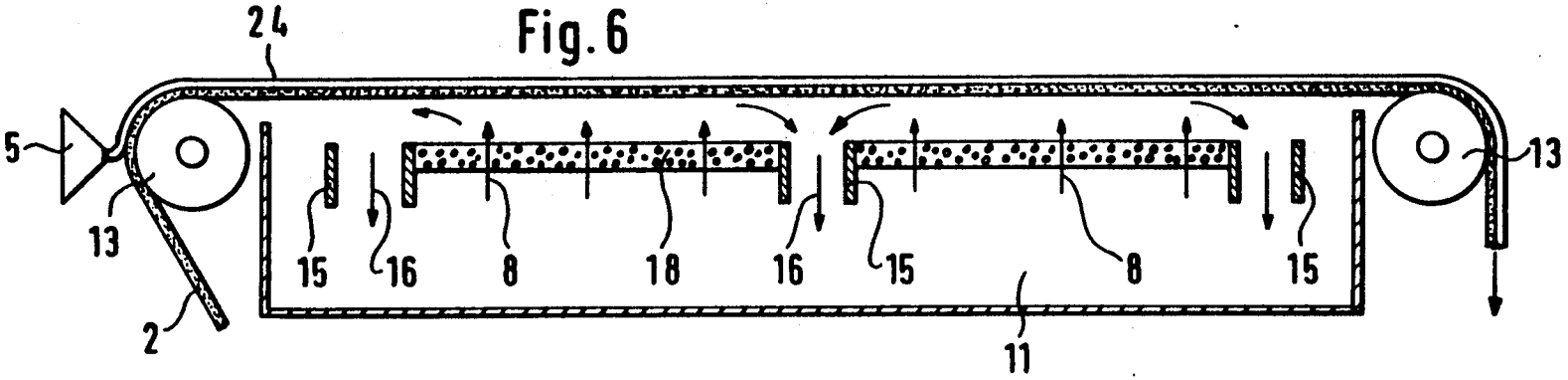
Figure 7:
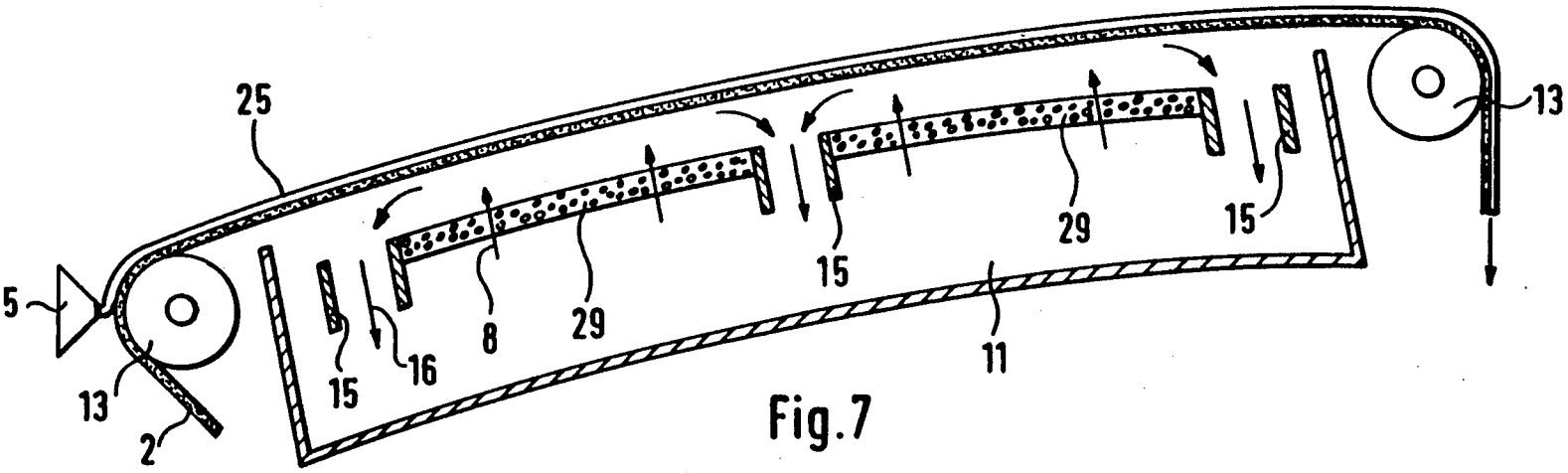

FIG. 6 shows a lower air supply system 11 of a fifth embodiment of the present apparatus, which comprises air inflow plates 18 of porous material. The substrate web 24 runs horizontally, parallel to the air inflow plates 18, and the air supply system 11 is similarly of horizontal design. The supply air 8 of the air supply system 11 passes through the porous material of the level air inflow plates 18 toward the underside of the substrate 2 and flows away as exhaust air 16 in return channels 15, which are present between the plates 18 and at the outer edges of the plates. The return channels 15 are arranged between the inflow zones transversely to the advancing direction of the substrate web 24. The sixth embodiment of the lower air supply system 11 according to FIG. 7 differs from FIG. 6 only in that the air supply system, and similarly the substrate web 25, are slightly curved. The air supply system 11 has correspondingly curved air inflow plates 29, which have the same curvature as the substrate web 25. The air inflow plates 29 are arranged at a distance from each other, and the exhaust air 16 flows away through return channels 15, which are fitted between the plates 29 as well as at the outer edges of the plates.

The upper air supply systems 12, associated with the lower air supply systems 11 according to FIGS. 4 to 7, resemble the upper air supply system 12 according to FIG. 1 and FIG. 2 and are therefore not represented again. The lower air supply systems 11 described here operate with an air-carrying cushion without mechanical support elements for the underside of the substrate web. With a horizontal path, an exact matching of the air flow conditions above and below the substrate web is necessary in order to accomplish a smooth and vibration-free web advancing. The curved path of the substrate web shows a better web stabilization than the horizontal path and results in vibration-free and smooth advancing of the substrate web without great expenditure.

Figure 8:
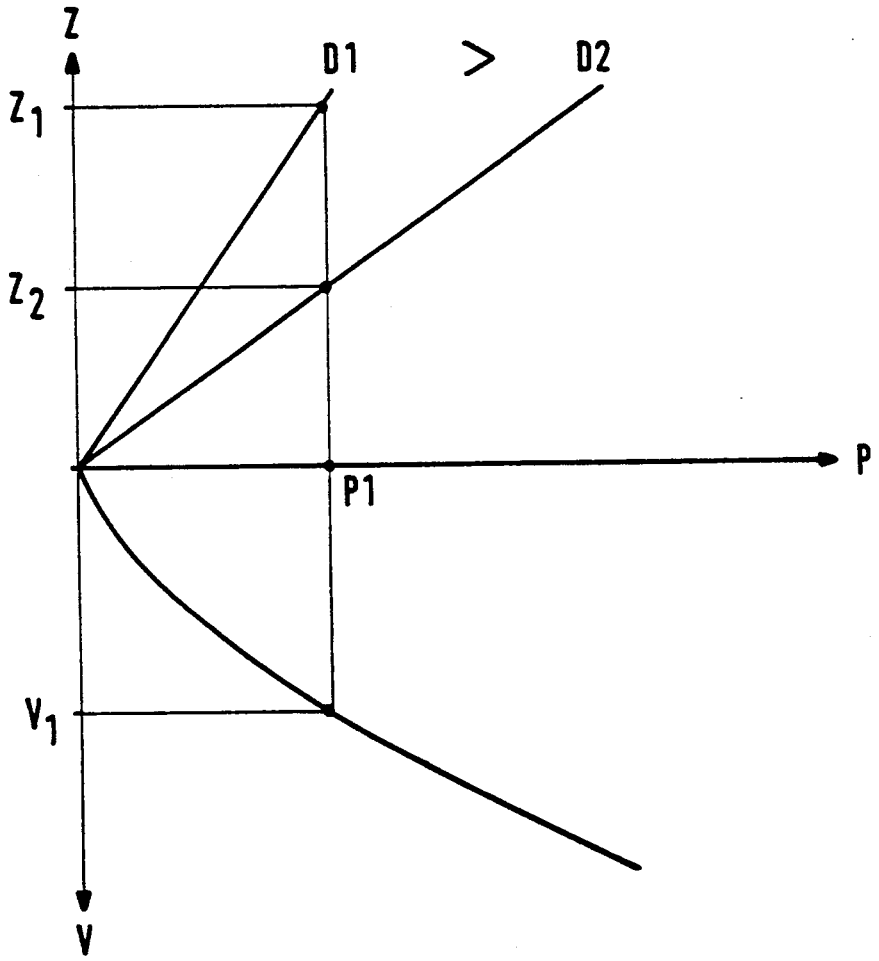
FIG. 8 shows the interrelationship between the strip tension Z on the substrate web and the bearing pressure P of the substrate web on the gas or air carrying cushion and the interrelationship between the advancing speed of the substrate web and the bearing pressure P.

FIG. 8 shows the graphical relationship between the bearing force P of the web on the carrying air cushion, the web tension Z and the air speed v of the supply air which flows against the underside of the slightly curved substrate web. The following relation applies for the equilibrium of forces of a web on a slightly curved guidance web with carrying air cushion:

$$P = \frac{2 \times Z}{DB}$$

wherein P is the bearing force ($N/m^2$) of the web on the air cushion, D is the imaginary diameter (m) of the curved substrate web, Z is the web tension $Z = B \times S \times K$, wherein B is the web width (m), S the web thickness (m) and K the specific web tension ($N/m^2$), usually approximately 10 $N/mm^2$, without taking into consideration the weight of the substrate web.

The bearing pressure P of the substrate web has to be opposed with at least the same force by the carrying air cushion of the supply air of the lower air supply system in order to avoid contact between the substrate web and the upper side of the lower air supply system. The carrying air flows underneath the substrate web into the return channels, as described above. This takes place at the air speed v corresponding to the pneumatic pressure of the carrying air cushion, for which speed Bernoulli's equation applies:

$$v = \sqrt{\frac{2}{\rho} \times P}$$

wherein v is the air speed (m/s) and $\rho$ is the density of the air (kg/m$^3$). The evacuating air speed of the rear-side exhaust air 16 determines, together with the air temperature, the rate of web heating and the rate of vaporization of the solvent components of the liquid film. If, for example, the bearing force of the substrate web is equal to P1, the diagram of FIG. 8 gives the associated minimum flowing-away speed v1 of the exhaust air 16 of the lower air supply system 12. It follows from the relation for the bearing force P that the latter is independent of the web width B and depends only on the web thickness S, the specific web tension K and the diameter D of the curved substrate web 25. For substrate webs of various thicknesses which are taken along the substrate web 25 with approximately the same specific web tension K there is a proportionality between the bearing force P, the web tension Z, the web thickness S and the square of the air speed $v^2$, these variables being approximately proportional to the necessary drying time. In other words, this means that the drying times depend substantially on the web thickness S.

FIG. 8 shows a linear relationship between the web tension Z and the bearing force P, with the parameters D1 and D2 equal to the diameters of variously curved substrate webs 25. At the same bearing force P1, with increasing diameter D1≧D2, it is necessary to choose the web tensions Z1 greater than Z2. In other words, this means that the more pronounced the curvature and the smaller D is, the more stable the web guidance with a small supporting force or lower air speed v.

In the case of the typical coatings of a liquid resist or photosensitive layer, generally more than two thirds of the drying energy is required for heating the aluminum web, for example 0.3 mm thick, with only the remainder of the drying energy available for the vaporization of the solvent components. An advantage associated with the present invention is that, by heating the back of the aluminum web or of the substrate web, a substantially larger portion of drying energy is made available for the vaporization of the solvent components than in the case of conventional apparatus.

In the case of most photosensitive or liquid resist coatings, immunity to adverse blowing is not ensured until about 70% of the solvent components have been vaporized from the coating film.

If the exhaust air speed v1 and the web thickness S are known, the necessary drying energy can be roughly calculated.

In the case of all apparatus, the substrate may also be supported, i.e., not freely suspended, while it is advanced.

What is claimed is:

1. A process for drying, by means of a heated drying gas, a liquid film which is applied to a moving substrate and includes vaporizable solvent components and solid components, comprising the steps of (a) suspending the moving substrate on a carrying cushion of the heated drying gas which flows against the underside of the moving substrate, (b) vaporizing a substantial portion of the solvent components via the contact between the heated drying gas and the underside of the moving substrate and (c) removing the vaporized solvent components from the upper side of the liquid film by passing a supply gas through an upper gas system comprising a first porous plate, flowing the supply gas along the upper side of the liquid film such that the supply gas becomes enriched with the vaporized solvent components and exhausting the solvent-enriched gas via a second porous plate, wherein the width of the upper gas system is wider than the width of the lower gas system.

2. A process as recited in claim 1, wherein the heated drying gas comprises air.

3. A process as recited in claim 1, wherein steps (a) and (b) comprise passing the heated drying gas towards the moving substrate through a lower gas system comprising plurality of slots arranged transversely to the advancing direction of the moving substrate, flowing the heated drying gas along the underside of the moving substrate and removing the heated drying gas via a plurality of return channels.

4. A process as recited in claim 1, further comprising removing the excess solvent-enriched gas of the upper gas via the return channels of the lower gas system.

5. A process as recited in claim 1, wherein the flow profile of the supply gas in the upper gas system is laminar and even.

6. A process as recited in claim 1, wherein the moving substrate is advanced horizontally level and the lower gas supply system on the underside of the substrate is aligned parallel to the horizontally-advancing substrate.

7. A process as recited in claim 1, wherein the moving substrate is advanced along a curved path and the lower gas supply system on the underside of the substrate is aligned along the same curvature as the moving substrate.

8. An apparatus for drying, by means of a heated drying gas, a liquid film which is applied to a moving substrate and includes vaporizable solvent components and solid components, comprising an upper gas supply system having a width greater than the lower gas system, arranged above the moving substrate, a lower gas supply system arranged underneath the moving substrate, an applying device which applies the liquid film to the moving substrate and means for advancing the substrate through a drying zone in a freely suspended condition on a carrying cushion produced by the lower gas supply system.

9. An apparatus as recited in claim 8, wherein the lower gas supply system comprises a plurality of slots arranged transversely to the advancing direction of the substrate, through which slots a gas supply passes, and a plurality of return channels for removal of the gas, wherein the slots and the return channels are arranged alternately, such that the gas introduced through the slots flows along the underside of the moving substrate and then is exhausted via the return channels.

10. An apparatus as recited in claim 8, wherein the upper gas supply system comprises a first section for introduction of a gas and a second section for removal of an exhaust gas, wherein each section includes a porous filter plate between which plates there is a gap.

11. An apparatus as recited in claim 10, wherein the upper gas supply system further comprises a pair of baffles arranged beneath the first and second sections respectfully, and terminating with the side edges of the filter plates such that the gas supply air is diverted by the baffles onto the moving substrate and returned over the substrate as return gas.

12. An apparatus as recited in claim 8, wherein the upper and lower gas supply systems are horizontally level and are arranged at a predetermined distance from the level, horizontal moving substrate.

13. An apparatus as recited in claim 8, wherein the upper and lower gas supply systems are arranged in a curved configuration, at a predetermined distance from the correspondingly curved moving substrate.

14. An apparatus as recited in claim 12, wherein the lower, level gas supply system further comprises a plurality of cylindrical bodies spaced apart from each other so as to form gaps which are arranged in transverse direction to the moving substrate, wherein the incoming gas flows through a gap and the exhaust gas flows through an adjacent gap.

15. An apparatus as recited in claim 13, wherein the lower, curved gas supply system further comprises a plurality of cylindrical bodies which are spaced apart from each other so as to form gaps and arranged along an arc which has the same curvature as the moving substrate, wherein the incoming gas flows through a gap and the exhaust gas flows through an adjacent gap.

16. An apparatus as recited in claim 12, wherein the lower, level gas supply system further comprises a plurality of porous gas inflow plates through which the incoming gas flows, wherein the gas inflow plates are arranged horizontally level and at a predetermined distance from each other so as to form at least one return channel through which the exhaust gas passes as well as past the outer edges of the plates.

17. An apparatus as recited in claim 13, wherein the lower, curved gas supply system further comprises curved gas inflow plates the curvature of which is the same as that of the moving substrate, wherein the gas inflow plates are arranged at a predetermined distance from each other so as to form at least one return channel through which the exhaust gas passes as well as past the outer edges of the plates.

18. A process for drying, by means of a heated drying gas, a liquid film which is applied to a moving substrate and includes vaporizable solvent components and solid components, comprising the steps of (a) suspending the moving substrate on a carrying cushion of the heated drying gas which flows against the underside of the moving substrate, (b) vaporizing a substantial portion of the solvent components via the contact between the heated drying gas and the underside of the moving substrate and (c) removing the vaporized solvent components from the upper side of the liquid film by passing a supply gas through an upper gas system comprising a first porous plate, flowing the supply gas along the upper side of the liquid film at a differential speed between the moving substrate and the supply gas of less than about 0.25 m/s, such that the supply gas becomes enriched with the vaporized solvent components, and exhausting the solvent-enriched gas via a second porous plate.

19. An apparatus for drying, by means of a heated drying gas, a liquid film which is applied to a moving substrate and includes vaporizable solvent components and solid components, comprising an upper gas supply system arranged above the moving substrate, a lower gas supply system arranged underneath the moving substrate, a partial dividing wall having an opening between the upper and lower gas supply systems and a pair of cover plates positioned underneath the moving substrate and attached at the respective sides of the opening, an applying device which applies the liquid film to the moving substrate and means for advancing the substrate through a drying zone in a freely suspended condition on a carrying cushion produced by the lower gas supply system.

20. A process as recited in claim 1, wherein said liquid film comprises light-sensitive or photosensitive constituents.

21. A process as recited in claim 20, wherein said moving substrate comprises a metal web.

* * * * *